US008661749B2

(12) United States Patent
Gibson

(10) Patent No.: US 8,661,749 B2
(45) Date of Patent: Mar. 4, 2014

(54) SYSTEM AND METHOD FOR INSTALLING A VINYL STAIR LINER TO A SET OF POOL STAIRS

(75) Inventor: Michael Gibson, Pickering, CA (US)

(73) Assignee: Associated Leisure Products, Inc., Norcross, GA (US)

( * ) Notice: Subject to any disclaimer, the term of this patent is extended or adjusted under 35 U.S.C. 154(b) by 44 days.

(21) Appl. No.: 13/339,816

(22) Filed: Dec. 29, 2011

(65) Prior Publication Data

US 2013/0167457 A1 Jul. 4, 2013

(51) Int. Cl.
*E04F 11/00* (2006.01)
*E04B 1/00* (2006.01)

(52) U.S. Cl.
USPC ..... 52/182; 52/169.7; 52/741.2

(58) Field of Classification Search
USPC ..... 52/182, 188, 169.7, 169.8, 741.1, 52/741.2, 741.4; 4/506, 488, 496, 501, 4/503; 277/630, 634, 637, 641, 642, 645, 277/652
See application file for complete search history.

(56) References Cited

U.S. PATENT DOCUMENTS

| | | | | | |
|---|---|---|---|---|---|
| 3,478,370 | A * | 11/1969 | Purpuri et al. | ..... | 52/188 |
| 4,343,120 | A * | 8/1982 | Witte | ..... | 52/184 |
| 4,713,849 | A * | 12/1987 | Kindness | ..... | 4/496 |
| 2013/0007956 | A1 * | 1/2013 | Korbel | ..... | 4/506 |

* cited by examiner

*Primary Examiner* — Jessica Laux
(74) *Attorney, Agent, or Firm* — Sand & Seboly

(57) ABSTRACT

A system and method for securing a vinyl pool stair liner to a set of pool stairs. The system includes a locking component that is secured to the stairs and a locking rod that is selectively engageable in a channel in the upper end of the locking component. The locking rod secures a flap of vinyl extending outwardly from an exterior surface of the stair liner into the channel and thereby secures the stair liner to the pool stairs. An installation tool is used to push the locking rod into the channel of the locking component. The locking rod is removable from the locking component to release the stair liner if it is determined that the liner should be replaced at a later date.

20 Claims, 13 Drawing Sheets

SYSTEM AND METHOD FOR INSTALLING A VINYL STAIR LINER TO A SET OF POOL STAIRS

BACKGROUND OF THE INVENTION

1. Technical Field

This invention relates generally to swimming pools. More particularly, this invention relates to stairs for climbing into and out of a swimming pool. Specifically, this invention is directed to a system and method for securing a vinyl pool liner to a set of pool stairs. The system includes a locking component, a locking rod and an installation tool. The locking component is secured to the stairs and defines a channel therein into which the locking rod is engaged by means of the installation tool. The locking rod clamps a vinyl flap extending from the stair liner into the locking component, thereby securing the stair liner to the pool stairs.

2. Background Information

Many of the newer metal-sided vinyl swimming pools have stairs built into one or more walls. These metal stairs are covered by the pool's vinyl liner to prevent them from being damaged by exposure to the water. The vinyl liner also serves to protect swimmers from being injured if they come into contact with the metal stairs.

The pattern for the vinyl pool liner having a region to cover the stairs is carefully manufactured so that the vinyl on the stairs will lay flat and will fit each stair tread without wrinkles and so that all of the seams will fall in the correct positions. Pool stairs get a lot of use so the vinyl must be locked into each tread in such a manner that it will not tend to shift over time. On new construction, the standard in the industry is to sonically weld a small piece of vinyl on the underside of each stair tread so that it forms a small pouch. Each stair tread has a small hole formed on the side wall. Once the vinyl is in place, a metal rod will be inserted into the small hole in the tread from the outside of the stair so as to engage the vinyl pouch on the underside of the tread. The ends of the rod will extend to the outside of the stair, thus locking the vinyl section on that tread. This is repeated for each tread. The pool is backfilled and the stair installation is complete. This works fairly well until the vinyl needs to be replaced because at this point, the rods are no longer removable from the stair assembly.

There is therefore a need in the art for an improved apparatus and method for installing a vinyl liner on a pool's metal stairs and which enable the vinyl liner to be quickly and readily replaced when it becomes damaged.

BRIEF SUMMARY OF THE INVENTION

A system and method for securing a vinyl pool stair liner to a set of pool stairs. The system includes a locking component that is secured to the stairs and a locking rod that is selectively engageable in a channel in the upper end of the locking component. The locking rod secures a flap of vinyl extending outwardly from an exterior surface of the stair liner into the channel and thereby secures the stair liner to the pool stairs. The locking component includes one or two lips that extend into the channel and engage in grooves defined in the interior surface of the locking rod. An installation tool is used to push the locking rod into the channel of the locking component. The locking rod is removable from the locking component if the stair liner is to be replaced at a later date.

The method of installing the vinyl pool stair liner on the pool stairs includes the steps of: securing a first locking component between a second tread and a first riser on the stairs; positioning a second riser portion of the stair liner adjacent a second riser of the pool stairs; positioning a second tread portion of the stair liner adjacent the second tread; positioning a region of a vinyl flap which extends outwardly from the exterior surface of the second tread portion across an opening to a channel in the first locking component; placing a first locking rod on the region of the vinyl flap that extends across the opening to the channel; engaging a bottom end of an installation tool in abutting contact with an interior surface of the locking rod; striking a top end of the installation tool with a hammer; driving the locking rod and the region of the vinyl flap into the channel with the installation tool; and pulling a free end of the vinyl flap upwardly to tighten the stair liner to the second tread.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
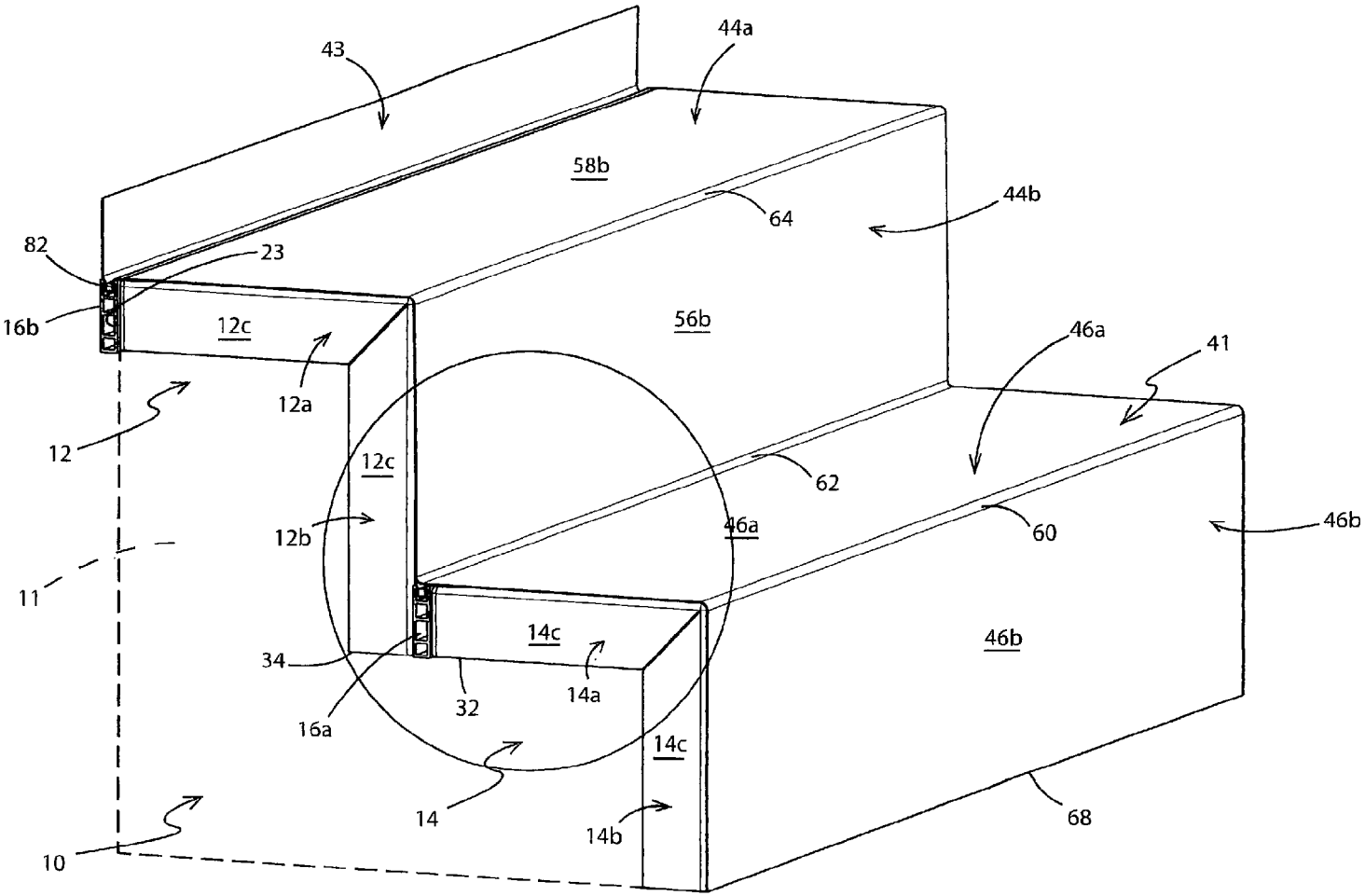
FIG. 1 is a perspective view of a set of pool stairs covered by a vinyl stair liner and having the sides of the stairs and the sides of the stair liner removed for clarity.
Figure 2:
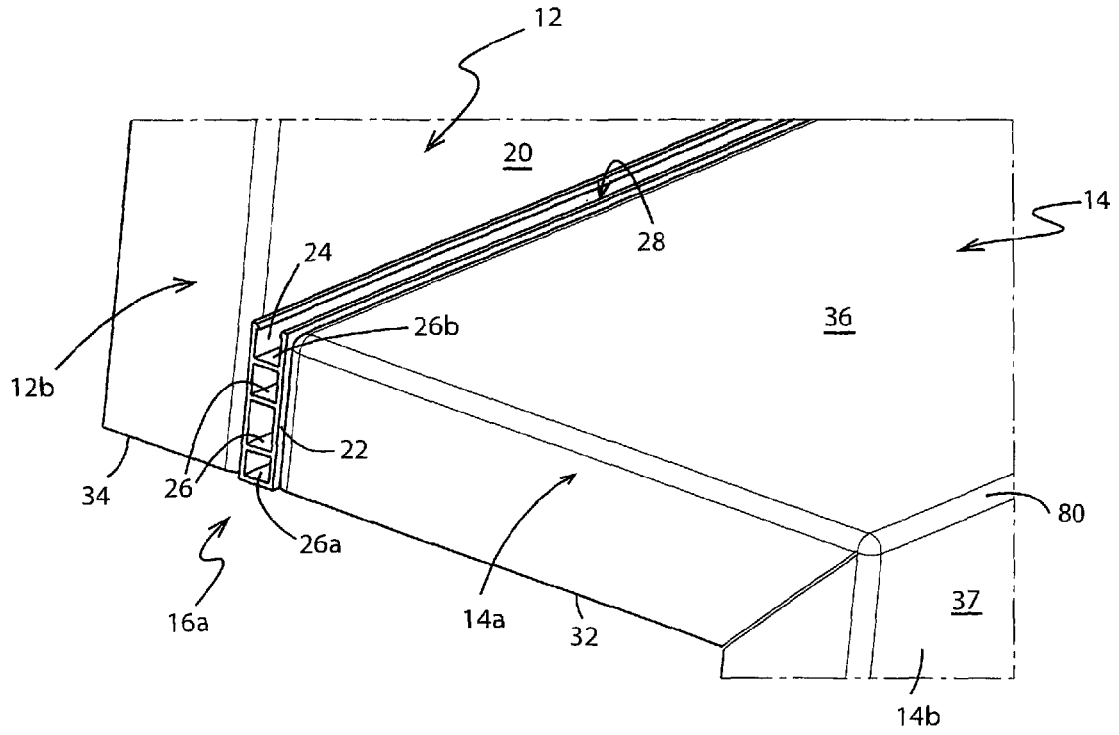
FIG. 2 is an enlarged perspective view of the highlighted region of FIG. 1 with the stair liner removed.

Referring to FIGS. 1 and 2 there is shown a set of pool stairs in accordance with the present invention and generally indicated at 10. The pool stairs 10 are covered by a vinyl pool liner 41. The pool stairs 10 include a first step 12 and a second step 14. First step 12 includes a first tread 12*a* and a first riser 12*b* and second step 14 includes a second tread 14*a* and a second riser 14*b*. First tread 12*a* and first riser 12*b* are disposed substantially at right angles to each other and second tread 14*a* and second riser 14*b* are disposed substantially at right angles to each other. Second tread 14*a* is further disposed substantially at right angles to first riser 12*b*. Pool stairs 10 preferably are manufactured from metal, although other materials such as a heavy duty plastic may, alternatively, be used for the manufacture of the stairs. It will be understood that pool stairs 10 may include any desired number of steps in addition to the first and second steps 12, 14 without departing from the scope of the present invention.

In accordance with a specific feature of the present invention, a locking system for securing vinyl pool liner 41 to pool stairs 10 is provided. The locking system includes a locking component 16*a* and a locking rod 38. The locking system may further include a installation tool 72 for engaging the locking rod 38 with the locking component 16*a*.

Locking component 16*a* is disposed between first and second steps 12, 14. More particularly, as shown in FIG. 2, locking component 16*a* is disposed between a rear surface 18 of second tread 14*a* and an surface 20 of first riser 12*b*. Locking component 16*a* preferably is manufactured from metal or plastic and preferably is extruded. Locking component 16*a* is an elongated member having a length "L" (FIG. 4) that is substantially of the same length as the second tread 14*a* and first riser 12*b* as measured between the opposed side walls 11. A second locking component 16*b* is secured to rear surface 23 of first tread 12*a*. Second locking component 16*b* is identical in structure and function to locking component 16*a* and is secured to first tread 12*a* in any suitable manner as previously described in relation to locking component 16*a*.

Pool stairs 10 further include a side wall that extends downwardly from adjacent the sides 12*c*, 14*c* (FIG. 1) at one end of first and second steps 12, 14. Side wall 11 is shown in FIG. 1 in phantom and it will be understood that a second side wall is disposed on the other end of first and second steps 12, 14. The side walls have been omitted from the rest of the figures for the sake of clarity of illustration.

Figure 3:
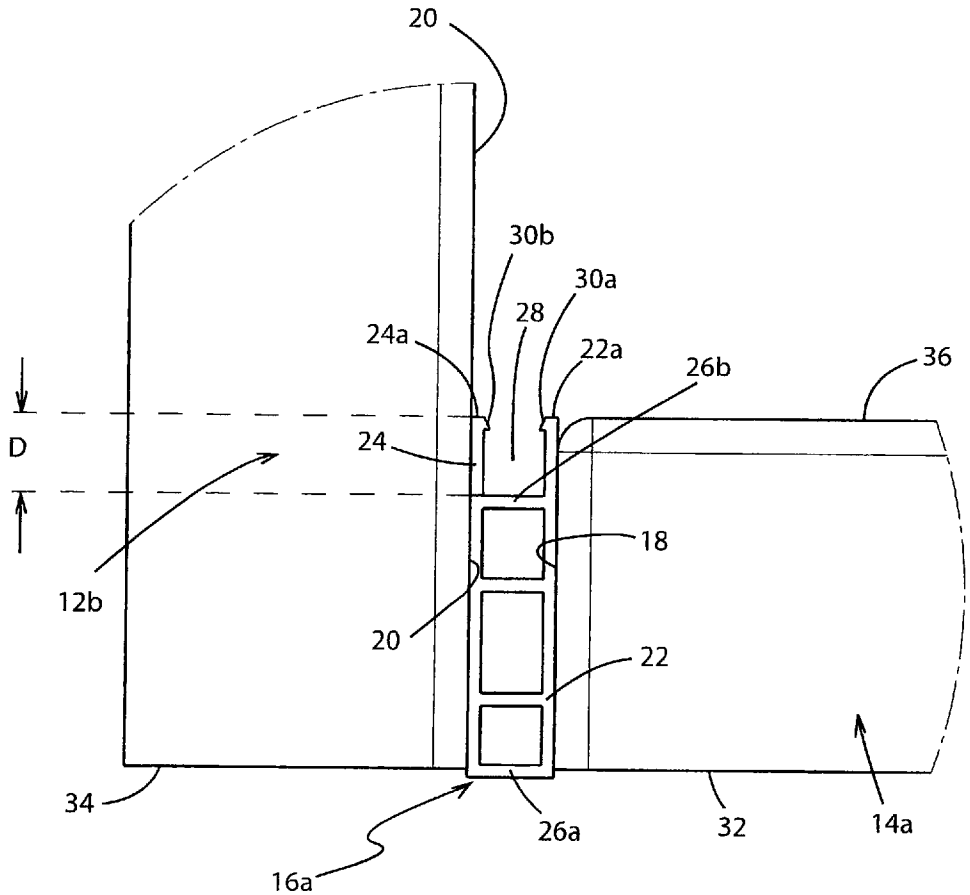
FIG. 3 is a left side view of a portion of the highlighted region shown in FIG. 2.
Figure 4:
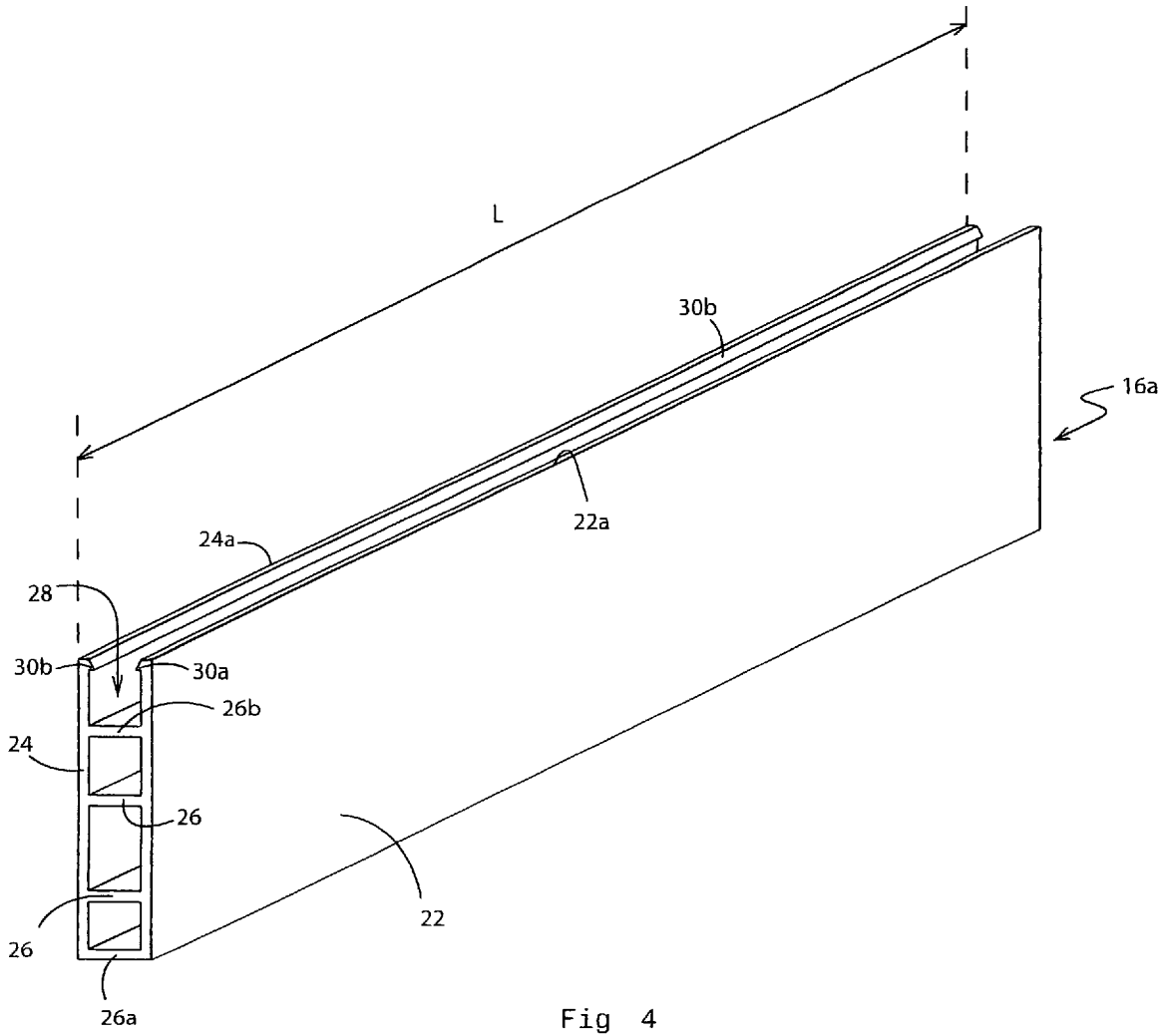
FIG. 4 is a perspective view of the locking component.

FIGS. 3 and 4 show that locking component 16*a* includes a first wall 22 and a second wall 24 which are disposed parallel to each other and spaced a distance apart. One or more ribs 26 extend between first and second walls 22, 24. A first one of the ribs, identified by the reference character 26*a*, forms a bottom wall of locking component 16*a*. A second one of the ribs, identified by the reference character 26*b*, forms a top wall of the locking component 16*a*. As best seen in FIG. 3, second rib 26*b* is disposed a distance "D" from the uppermost edges 22*a*, 24*a* of first and second walls 22, 24. A channel 28 is defined between a region of the inner surface of first wall 22, a region of the inner surface of second wall 24 and the uppermost surface of second rib 26*b*. Additionally, each of the uppermost edges 22*a*, 24*a* is provided with an inwardly extending lip 30*a*, 30*b*, and these lips 30*a*, 30*b* extend toward each other. Channel 28 thus has a depth "D" (FIG. 3) and a width "W", except in the region between the lips 30*a*, 30*b* where the width is "W1".

In accordance with the present invention and as indicated previously, locking component 16*a* is sandwiched between surface 20 of first riser 12*b* and rear surface 18 of second tread 14*a*. Locking component 16*a* is secured to both first and second steps 12, 14. Although not illustrated herein, locking component 16*a* preferably is secured to first and second steps 12, 14 by a plurality of bolts during assembly of pool stairs 10. It will be understood that locking component 16*a* may, alternatively, be welded to first and second steps 12, 14 or secured thereto by any other suitable means. Locking component 16*a* is oriented so that first rib 26*a* is substantially aligned with the bottom surface 32 of second tread 14*a* and with the bottom surface 34 of first riser 12*b*. Furthermore, uppermost edges 22*a*, 22*b* of locking component 16*a* are substantially aligned with surface 36 of second tread 14*a*. Additionally, the opening to channel 28 faces upwardly.

Figure 5:
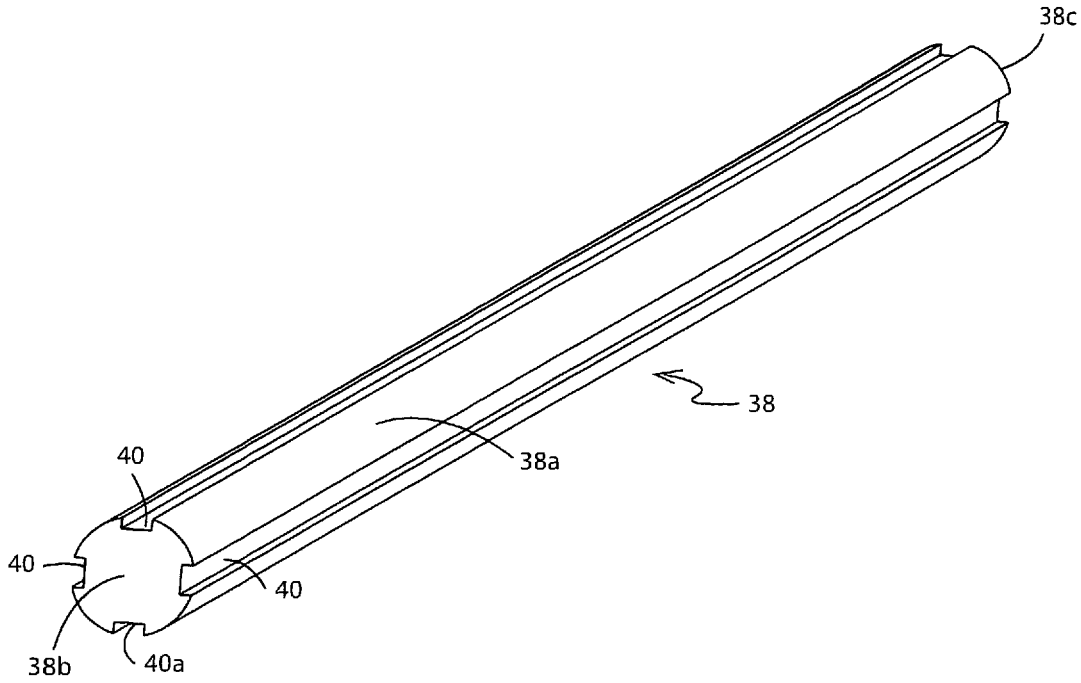
FIG. 5 is a perspective view of a locking rod for engagement with the locking component.
Figure 6:
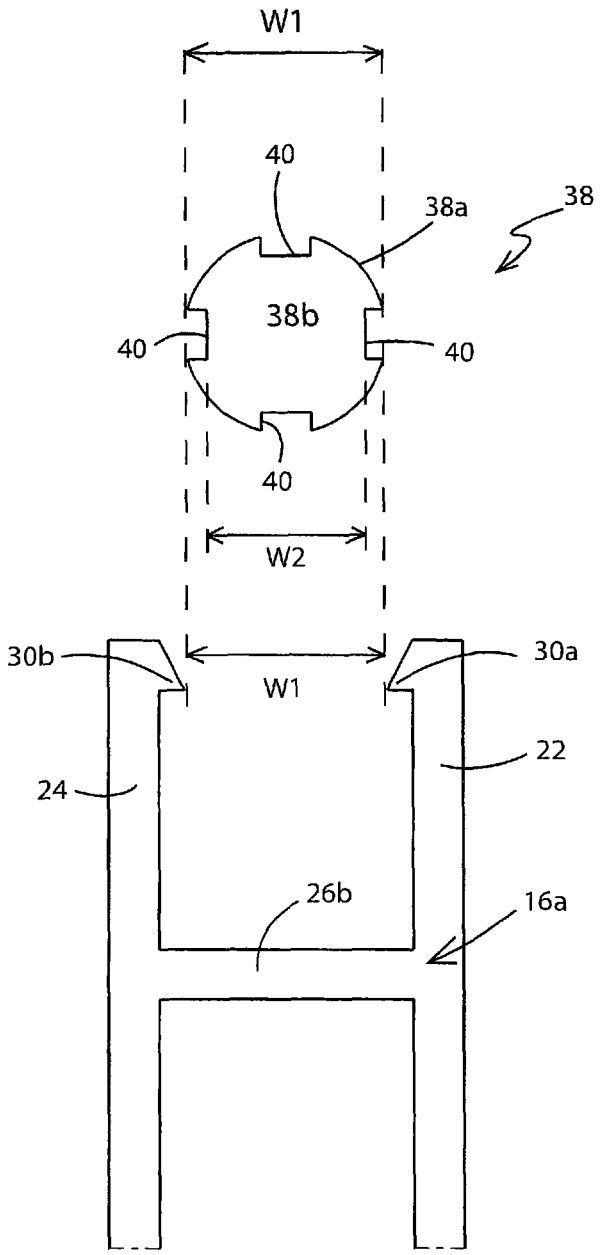
FIG. 6 is a left side view of the locking rod and an upper end of the locking component.

In accordance with yet another feature of the present invention, locking rod 38 is provided for engagement in channel 28 in upper end of locking component 16*a*. Locking rod 38 is shown in greater detail in FIGS. 5 and 6. Locking rod 38 is an elongate member having a length that preferably is slightly less than the length "L" of locking component 16*a*. Preferably, locking rod 38 is manufactured from metal or plastic. Still further, locking rod 38 preferably is an extruded component. Locking rod 38 is a generally cylindrical member that is provided with one or more U-shaped grooves 40 in its exterior surface 38*a*. Preferably, locking rod 38 includes four grooves 40 that are spaced equidistant from each other along the circumferential exterior surface 38*a*. Each groove 40 extends longitudinally along locking rod 38 and originates proximate a first end 38*b* of rod 38 and terminates proximate a second end 38*c* thereof. It should be noted that the diameter "W1" (FIG. 6) of rod 38 in the regions free of grooves 40 is slightly less than the width "W" of locking component 16*a*. The distance "W2" (FIG. 6) between the innermost surfaces of rod 38 that define grooves 40 is slightly less than the width "W1", the distance between lips 30*a*, 30*b* on locking component and the width of exterior surface 38*a*.

Figure 7:
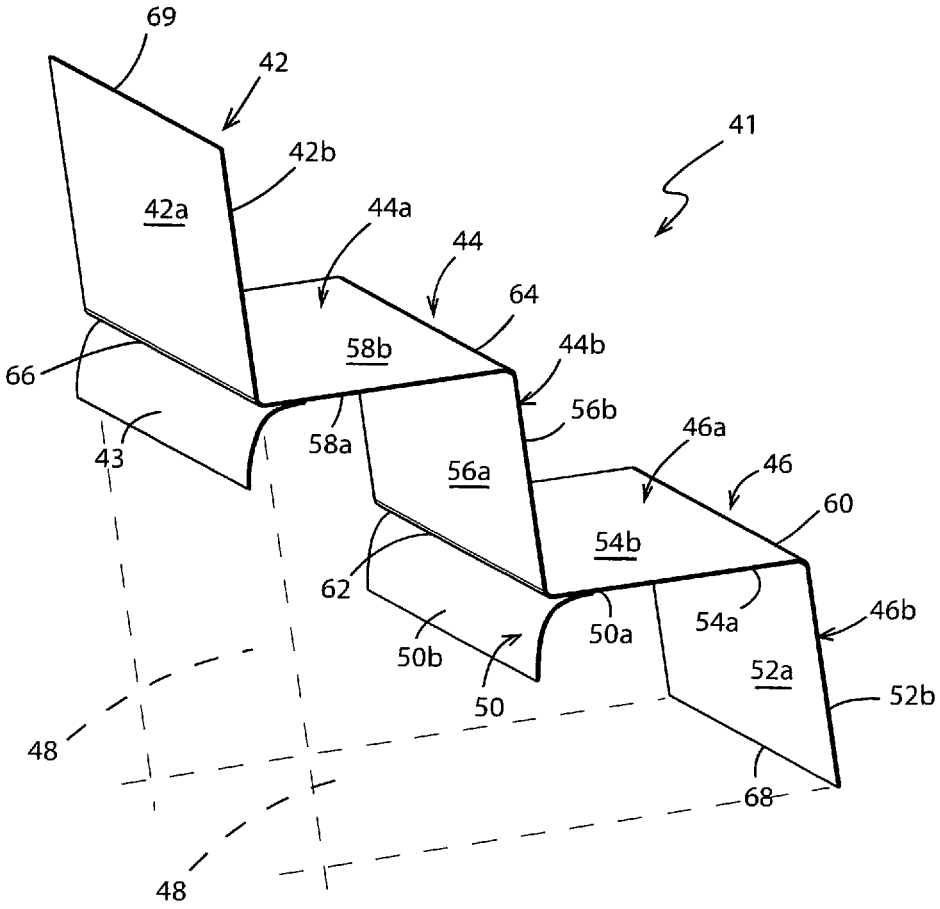
FIG. 7 is a rear perspective view of a portion of the vinyl stair liner for covering the pool stairs of FIG. 1, and showing the flaps secured to the exterior surface of the stair tread regions of the stair liner.

Referring to FIG. 7 shows a vinyl stair liner 41 that is engageable with pool stairs 10 to cover, protect, and waterproof the same. Stair liner 41 includes a first step liner 44, a second step liner 46, a pair of opposed side walls 48 (shown only in FIG. 7 and shown therein in phantom), and a locking flap 50. Stair liner 41 further includes a wall liner 42 and a second locking flap 43.

Wall liner 42 is configured to be installed so that it is substantially vertically oriented and engaged with a portion of the vinyl pool liner that covers a region of the wall of the swimming pool immediately above and adjacent to pool stairs 10. First step liner 44 includes a first tread portion 44*a* and a first riser portion 44*b*. Second step liner 46 includes a second tread portion 46*a* and a second riser portion 46*b*. Preferably, wall liner 42, first tread portion 44*a*, first riser portion 44*b*, second tread portion 46*a*, and second tread portion 46*b* are integrally formed. It will be understood by those skilled in the art that each of the wall liner 42, the first and second tread portions 44*a*, 46*a*, and first and second riser portions 44*b*, 46*b* may be separately formed and then secured together by heat welding or any other suitable securement method.

It will further be understood that if pool stairs 10 include more than just the first and second steps 12, 14, that stair liner 41 will be manufactured to be complementary thereto and will include an identical number of step liners to the number of steps provided in pool stairs 10. Furthermore, additional locking flaps will be provided at each transition between the tread portion of one of the step liners and the riser portion of the step liner disposed adjacent thereto.

FIG. 7 shows that wall portion 42 has an exterior surface 42*a* and an interior surface 42*b*. Second riser portion 46*b* has an exterior surface 52*a* and an interior surface 52*b*; second tread portion 46*a* has an exterior surface 54*a* and an interior surface 54*b*; first riser portion 44*b* has an exterior surface 56*a* and an interior surface 56*b*; and first tread portion 44*a* has an exterior surface 58*a* and an interior surface 58*b*. A first transition region 60 is disposed between second riser portion 46*b* and second tread portion 46*a*. A second transition region 62 is disposed between second tread portion 46*a* and first riser portion 44*b*. A third transition region 64 is disposed between first riser portion 44*b* and first tread region 44*a* and a fourth transition region 66 is disposed between first tread portion 44*a* and wall portion 42. Second riser portion 46*b* has a free edge 68 that is securable to a portion of the pool liner (not shown) situated below pool stairs 10, and wall portion 42 has a free edge 69 that is securable to another portion of the pool liner situated above pool stairs 10.

Figure 8:
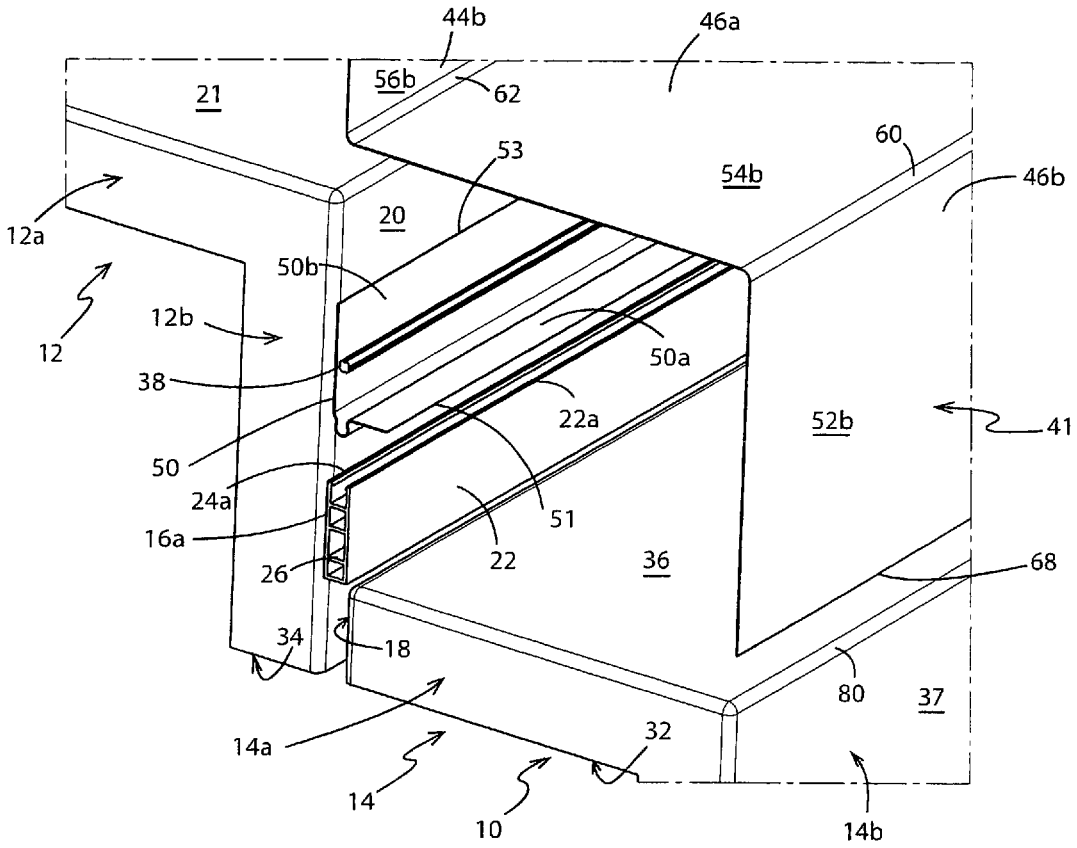
FIG. 8 is an exploded partial front perspective view showing the stair liner being engaged with the pool stairs.

FIG. 8 shows locking flap 50 exploded away from stair liner 41. Locking flap 50 preferably is substantially the same length as second tread portion 46*a* and first riser portion 44*b* or is slightly shorter in length relative thereto. A longitudinally aligned first region 50*a* of locking flap 50 is heat welded or otherwise secured to exterior surface 54*a* of second tread portion 46*a* and extends away therefrom. First region 50*a* is secured thereto a distance inwardly from the transition region 60 between second tread portion 46*a* and first riser portion 44*b*. A longitudinally aligned second region 50*b* of locking flap 50 is free of any connections to either of the first and second step liners 44, 46. Locking flap 50 has a width that is measured from the edge 51 (FIG. 8) of first region 50*a* to the edge 53 of second region 50*b*. The width of locking flap 50 is such that the edge 53 thereof is disposed a distance inwardly away from the transition region 62 between first riser portion 44*b* and first tread portion 44*a* when stair liner 41 is fixedly engaged with pool stairs 10.

FIGS. 8-12 illustrate how the locking system may be used to secure stair liner 41 with pool stairs 10. In accordance with the present invention, installation begins at the lowermost step in pool stairs 10, thus, in the case illustrated in the attached figures, installation begins at second step 14.

Figure 9A:
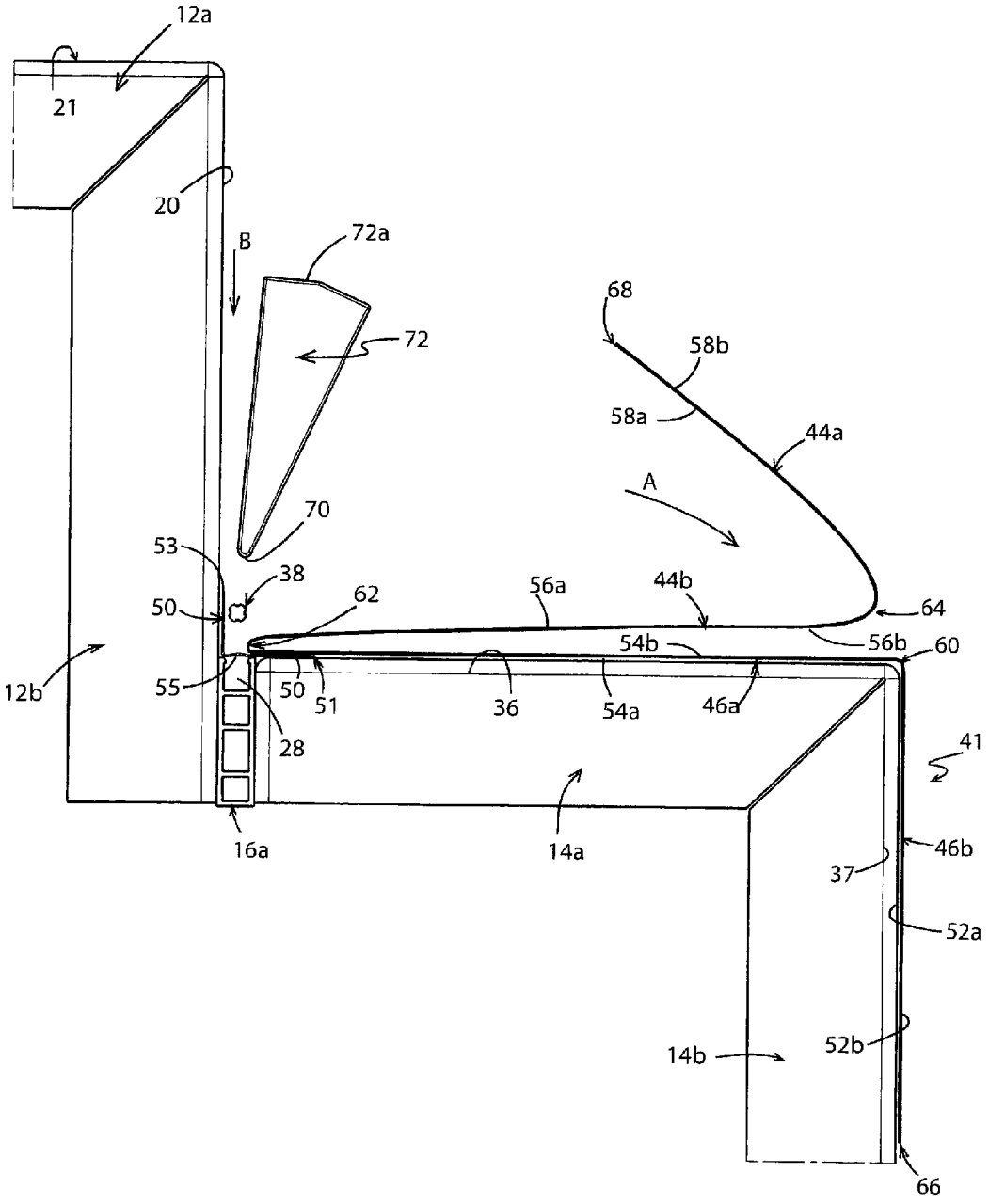
FIG. 9*a* is a partial left side view showing the stair liner being engaged with the pool stairs and showing a first locking flap in an initial position prior to engagement therewith by the locking rod.

Referring to FIGS. 8 and 9, stair liner 41 is initially positioned adjacent pool stairs 10 in such a way that exterior surface 52*a* of second riser portion 46*b* is disposed adjacent surface 37 of second riser 14*b* and exterior surface 54*a* of second tread portion 46*a* is disposed adjacent surface 36 of second tread 14*a*. FIG. 9*a* shows first tread portion 44*a* and first riser portion 44*b* have been rotated in the direction of arrow "A" away from first riser 12*b*. This pulling back of the rest of stair liner 41 enables the installer to gain access to flap 50 and to locking component 16*a*. Flap 50 extends rearwardly toward first riser 12*b* and is positioned by the installer so that a region 55 of flap 50 extends across the opening to channel 28 in locking component 16*a*. The rest of flap 50, including second region 50*b* thereof, extends for a distance upwardly along surface 20 of first riser 12*b*. It should also be noted that transition 60 on stair liner 41 is disposed generally adjacent the transition 80 between second riser 14*b* and second tread 14*a*.

Figure 9B:
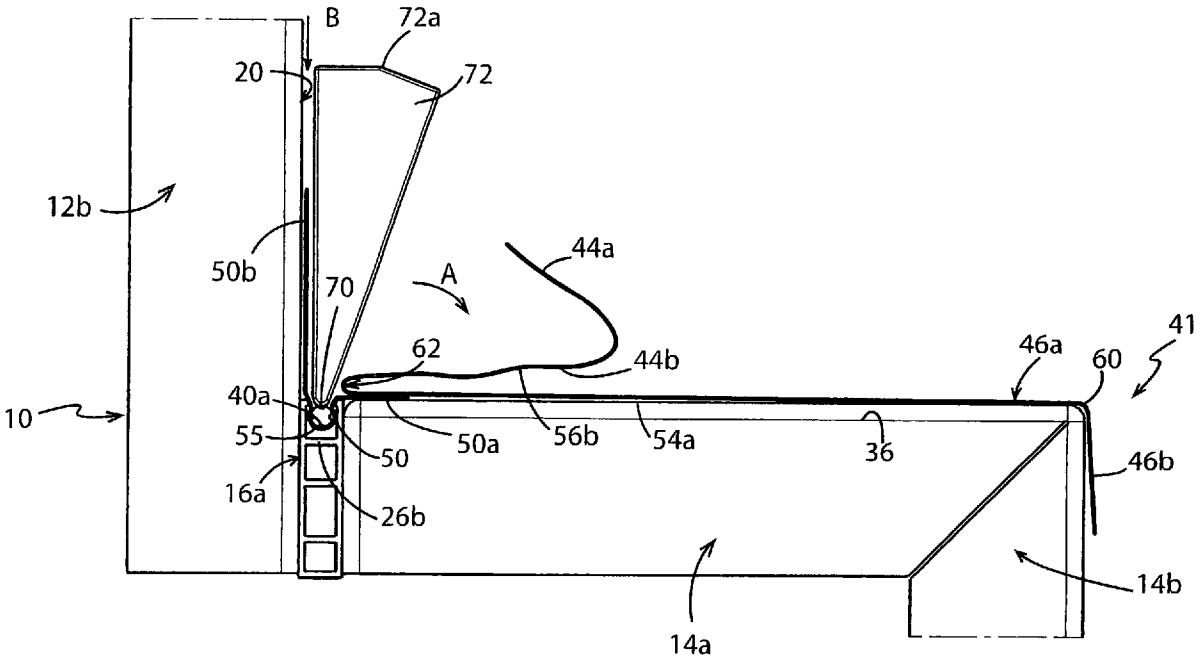
FIG. 9*b* is a partial left side view of the pool stairs and stair liner showing the installation tool engaging the locking rod and forcing the same into the locking component.
Figure 10:
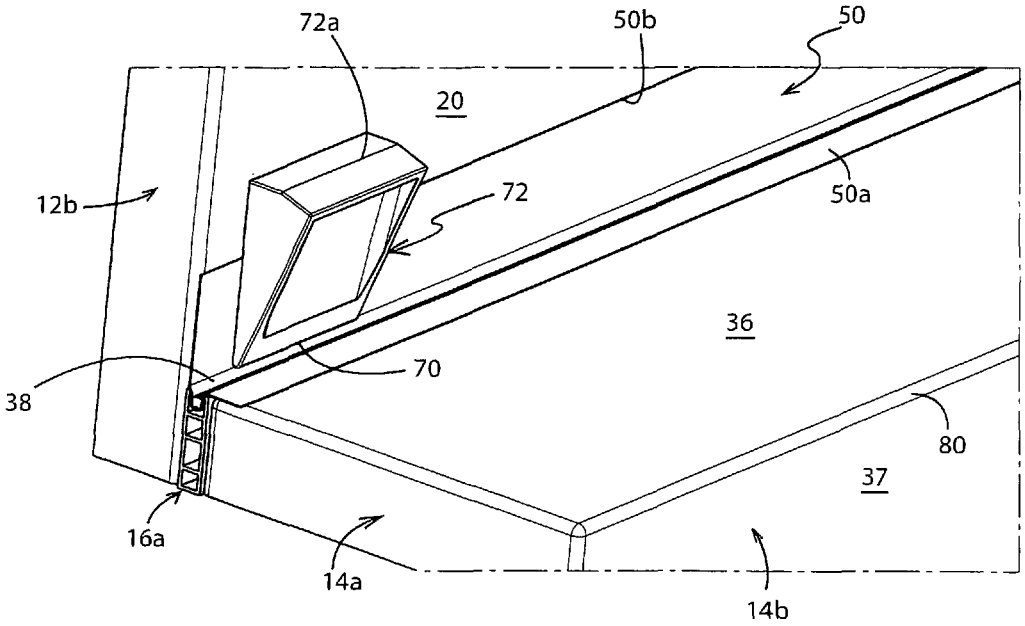
FIG. 10 is a partial perspective view of the locking rod being pushed downwardly by the installation tool to secure the locking flap into the locking component, and wherein the rest of the stair liner has been removed for clarity.

The installer then places locking rod 38 of locking system on the uppermost surface of flap 50 so that locking rod 38 extends longitudinally along the region 55 of locking flap 50. The installer then contacts a first region of locking rod 38 proximate one end thereof, with an apex 70 of an installation tool 72 as illustrated in FIG. 9*b*. (It should be noted that only a portion of stair liner 41 is shown in FIG. 9*b* for the sake of clarity). Installation tool 72 may also form part of the locking system in accordance with the present invention. Installation tool 72 is generally V-shaped when viewed from the side and the apex 70 thereof is substantially flat along its length. The apex 70 is of a width that is slightly narrower than the width "W" of locking rod 38. The back 72*a* of tool 72 is several times wider than the apex 70 and is suitable for being struck by a hammer. Using a hammer to strike the back 72*a* of tool 72 when the apex 70 thereof is in contact with locking rod 38, the installer forces the locking rod 38 and the region 55 of locking flap 50 downwardly in the direction of arrow "B" (FIG. 9*b*) and into channel 28 of locking component 16*a*. This downward motion forces region 55 and locking rod 38 to engage lips 30*a*, 30*b* of locking component 16*a*. The rigid rod 38 forces lips 30*a*, 30*b* to move slightly apart so that rod 38 and region 55 of locking flap 50 enter channel 28. When lips 30*a*, 30*b* effectively enter grooves 40, the downward motion of rod 38 ceases, lips 30*a*, 30*b* return to their original, non-deflected position, and rod 38 and a portion of the locking flap 50 become snap-fittingly engaged in channel 28. The installer moves the tool 72 laterally along locking rod 38 and repeats the hammering procedure until the entire locking rod 38 is engaged in locking component 16*a*. Lips 30*a*, 30*b* and their engagement in grooves 40 helps to secure locking flap 50 within locking component 16*a*.

Once rod 38 is completely engaged in locking component 16*a*, tool 72 is removed and the installer will then grasp the second region 50*b* of flap 50 and pull it upwardly in the direction of arrow "B", thereby pulling the second tread portion 46*a* of pool line 41 tightly into place on second tread 14*a* of pool stairs 10. The installer thus ensures that transition 60 on stair liner 41 is correctly positioned along transition 80 on pool stairs 10 and that second tread portion 46*a* is substantially free of wrinkles.

Figure 11:
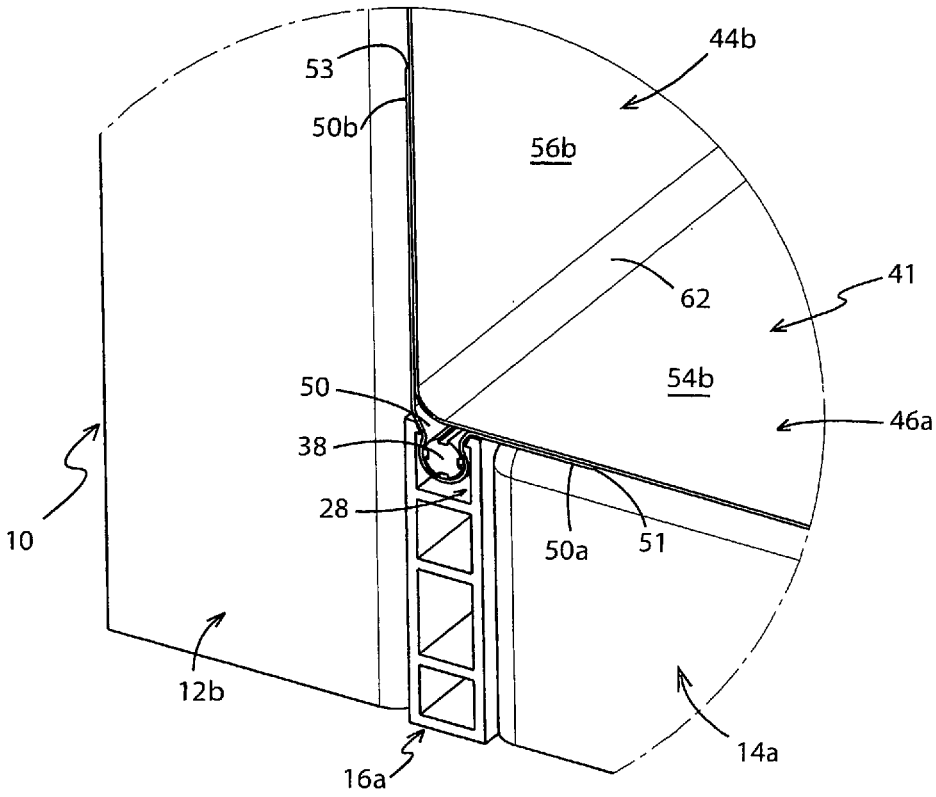
FIG. 11 is a partial perspective view of the locking flap secured into the locking component by the locking rod and with the stair liner installed in abutting contact with the stair tread and stair riser.
Figure 12:
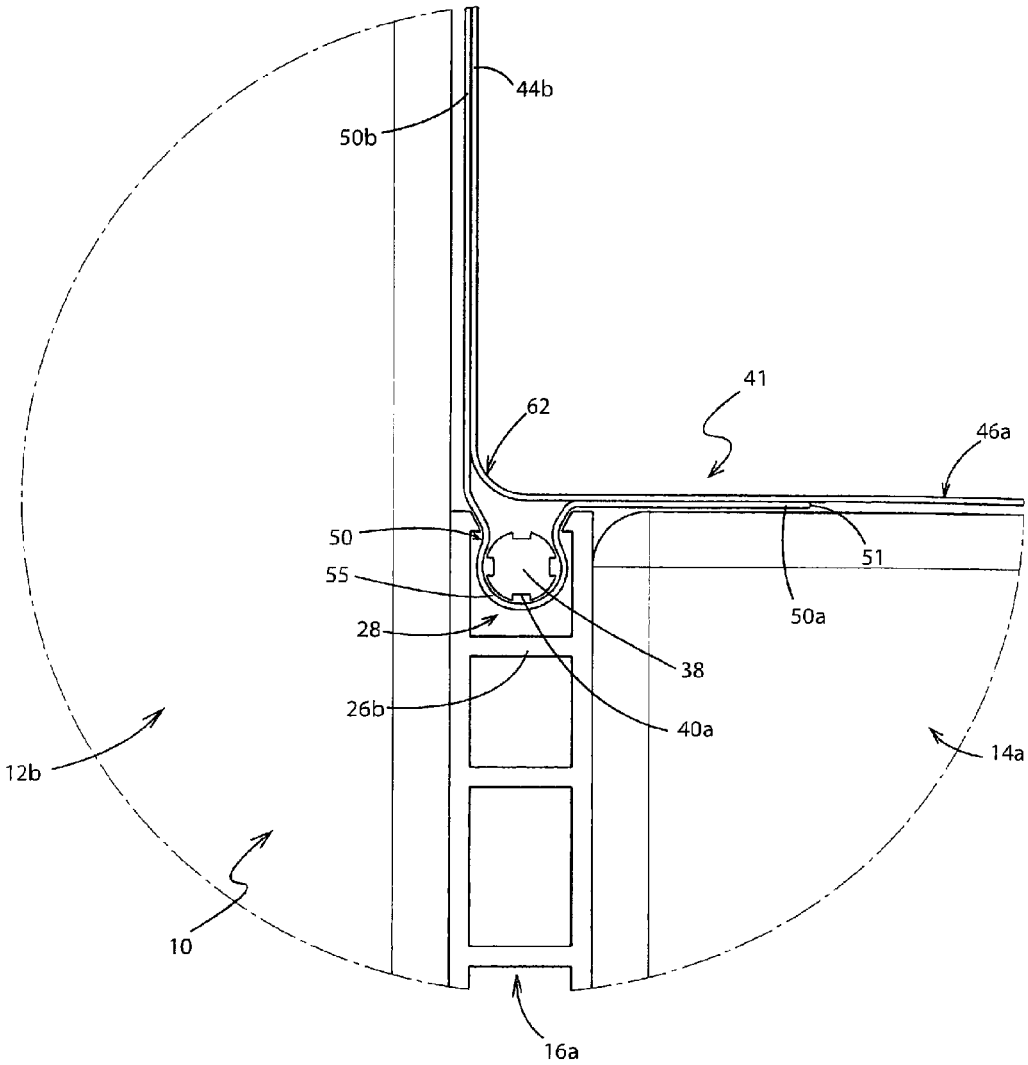
FIG. 12 is a left side view of the locking flap secured into the locking component by the locking rod and with the stair liner installed in abutting contact with the stair tread and stair riser.

First step portion 44 of stair liner 41 is rotated in the opposite direction to arrow "A" so that exterior surface 56*a* of first riser portion 44*b* comes into abutting contact with first riser 12*b* and exterior surface 58*a* of first tread portion 44*a* comes into abutting contact with surface 21 (FIG. 9*a*) of first tread 12*a*. At this point, wall portion 42 remains rotated in the same direction as arrow "A" and away from pool stairs 10 so that locking flap 43 on first tread portion 44*a* may be more easily accessed. Locking flap 43 is then engaged in second locking component 16*b* by engaging a second locking rod 82 (FIG. 1) in second locking component 16*b* in the manner previously described with reference to locking component 16*a*, locking flap 50 and locking rod 38. Once second locking rod 82 is secured in the channel in second locking component 16*b*, locking flap 43 is pulled upwardly in the direction of arrow "B" so that first tread portion 44*a* fits tightly on first tread 12*a* and is substantially free of wrinkles. FIGS. 11 and 12 show stair liner 41 installed tightly in abutting contact with pool stairs 10. Wall portion 42 is then rotated in the opposite direction to arrow "A" and into abutting contact with the pool wall above pool stairs 41. Wall portion 42 is then secured by any suitable means known in the art to the vinyl pool liner that surrounds the upper region of pool stairs 10. Side walls 48 of stair liner 41 are similarly secured to the vinyl pool liner that surrounds pool stairs 10 in any suitable manner known in the art.

If additional steps are provided as part of pool stairs 10 and vinyl stair liner 41 therefore includes additional step portions, for instance a step portion that is disposed on an additional step that extends downwardly from second step 14, then a third locking flap will be provided on that additional step portion. The third locking flap will be engaged by a third locking rod in a third locking component disposed between the second step 14 and the additional step in the same way as has been described previously.

If it is later necessary to replace stair liner 41 because it has become damaged or worn, then stair liner 41 is detached from the surrounding pool liner. This is accomplished by removing the second locking rod 82 from second locking component 16*b* and removing locking rod 38 from locking component 16*a*. The removal process is started at the top of pool stairs 10.

Wall portion 42 is cut free from the surrounding pool liner and is rotated downwardly toward interior surface 58*b* of first tread portion 44*a*. Once second flap 43 is freed, the stair liner 41 is again rotated in the direction of arrow "A" and when locking rod 38 is revealed, it is detached from locking component 16*a* in the same manner and stair liner 41 is then discarded. Locking rod 38 and second locking rod 82 are readily detached from the associated locking component 16*a*, 16*b* by inserting the head of a flat-head screwdriver into the groove 40*a* (FIGS. 5 & 9) disposed adjacent rib 26*b*. The handle of the screwdriver is moved downwardly in the direction of arrow "B", thus forcing that end of the locking rod out of the channel 28 in the locking component. The opposite end of the locking rod may be removed from the opposite end of the locking component 16*a*, 16*b* in like manner or the locking rod may be grasped at the free end and pulled upwardly in an arc to release it from locking component 16*a*, 16*b*.

A new stair liner (not shown) may then be engaged with pool stairs 10 in the same manner as described previously. The locking rod 38 and second locking rod and the locking components 16*a* may be reused in the installation of the new stair liner.

The system may be used as the pool stairs 10 are constructed or may the system may be retrofitted to a set of existing stairs. The system may be incorporated into a set of pool stairs to form a pool stair assembly where the locking components 16*a*, 16*b* are installed at the factory and the locking rods and installation tool are provided as part of the pool stair assembly and the locking rods and installation tool are utilized at the jobsite to install a stair liner.

The present invention and method of installing the same has several advantages over the prior art. Firstly, the device of the present invention is removable and the vinyl liner is replaceable as nothing is on the outside of the stair. The device of the present invention enables the pool installer to tighten the liner to each stair tread far more accurately than the pre-formed pouch and interior rod approach used in the prior art. Furthermore, the device of the present invention is less costly for the liner manufacturer to add flaps on the underside of the liner than was the case when pouches had to be included on each stair tread.

It will be understood that instead of the locking component being oriented vertically so that the channel therein opens upwardly, the locking component may, alternatively, be installed horizontally so that the tops of the first and second walls of the locking component are aligned with the interior surface of the riser. If the locking component is oriented in this manner, the channel will be horizontally disposed and the locking rod will be engaged therein so as to secure a flap that extends outwardly from the exterior surface of the riser portion of the stair liner into the locking component. It will further be understood that the locking channel may, alternatively be built into the body of either a riser or tread of the step, i.e., in a location that is not at adjacent one of the front or rear edges of the riser or tread. Furthermore, it will be understood that the locking component could, alternatively, be oriented so that it runs from the front of the tread to the back thereof instead of from a left side to a right side thereof, or from a top of a riser to the bottom thereof instead of from a left side to a right side thereof. The flaps extending outwardly from the exterior surface of the stair liner will then be positioned so as to be complementary to the location and orientation of the locking component.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A system for securing a vinyl pool stair liner to a set of pool stairs, wherein said system comprises:

a locking component adapted to be secured to the pool stairs;

a channel defined in the locking component; and a locking rod selectively engageable with the locking component; and wherein substantially the entire locking rod is received within the channel of the locking component when the locking rod is engaged therewith; and wherein the locking rod is adapted to secure a flap of vinyl extending away from an exterior surface of the stair liner to the locking component and to thereby secure the stair liner to the pool stairs; and at least a portion of the flap is received in the channel and is captured between the locking component and the locking, rod; and wherein the locking component comprises: a first wall having an outer surface, an inner surface, a first end, a second end, a top and a bottom;

a second wail having an outer surface, an inner surface, a first end, a second end, a top and a bottom, and wherein the second wall is disposed parallel to the first wall and spaced a distance therefrom; and a rib extending between the inner surface of the first wall and the inner surface of the second wall and spaced a distance downwardly away from the tops of the first and second walls; and wherein the channel is defined by a region of the inner surface of the first wall, a region of the inner surface of the second wall, and an upper surface of the rib.

2. The system as defined in claim 1, wherein the locking component further comprises: a first lip extending inwardly into the channel from the inner surface of the first wall, wherein said first lip is disposed proximate the top of the first wall; and wherein the first lip engages the locking rod and substantially prevents the locking rod from being inadvertently withdrawn from within the channel.

3. The system as defined in claim 2, wherein the locking rod is generally cylindrical and has an exterior surface, a first end and a second end.

4. The system as defined in claim 3, further comprising:

a first groove defined in the exterior surface of the locking rod, wherein the first groove is disposed substantially parallel to a longitudinal axis of the locking rod and extends from the first end of the locking rod to the second end thereof.

5. The system as defined in claim 4, further comprising:

a second lip extending inwardly into the channel from the inner surface of the second wall, wherein said second lip is disposed proximate the top of the second wall.

6. The system as defined in claim 5, further comprising:

a longitudinally oriented second groove defined in the locking rod and extending between the first and second ends thereof; wherein said second groove is disposed opposite the first groove on the exterior surface of the locking rod.

7. The system as defined in claim 5, further comprising:

a longitudinally oriented second groove defined in the locking rod and extending between the first and second ends thereof; wherein said second groove is disposed opposite the first groove on the exterior surface of the locking rod;

a longitudinally aligned third groove and fourth groove defined in the locking rod and extending between the first and second ends thereof; and wherein the first, second, third and fourth grooves are disposed generally equidistant around the circumference of the locking rod, and wherein the third groove is disposed opposite the fourth groove.

8. A system for securing a vinyl pool stair liner to a set of pool stairs, wherein said system comprises:

a locking component adapted to be secured to the pool stairs;

a locking rod selectively engageable with the locking component; wherein the locking rod is adapted to secure a flap of vinyl extending away from an exterior surface of the stair liner into the locking component and to thereby secure the stair liner to the pool stairs; and an installation tool for engaging the locking rod in the locking component; and wherein the tool has a first surface, a second surface, a top, a bottom, a first side and a second side; and wherein the bottom is narrower in width than is the top, where the width is measured as the distance between the first and second surfaces; and wherein the bottom of the tool engages the locking rod.

9. The system as defined in claim 8, wherein the bottom of the installation tool is substantially flattened and the width of the bottom of the tool is narrower than a diameter of the locking rod.

10. The system as defined in claim 9, wherein the top of the installation tool is substantially flattened and is adapted to be struck by a hammer.

11. A pool stair assembly for securing a vinyl pool stair liner thereto, said pool stair assembly comprising:

a set of pool stairs including a first step having a first riser and a first tread, and a second step having a second riser and a second tread;

a locking component secured between the second tread and the first riser, said locking component having an upper end that is substantially flush with an interior surface of the second tread;

a channel defined in the upper end of the locking component; and a locking rod selectively engageable in the channel of the locking component; said locking rod being received substantially entirely within the channel when so engaged and wherein the locking rod is adapted to clamp a flap of vinyl extending outwardly from an exterior surface of the stair liner between a portion of an exterior surface of the locking rod and an inner surface of the locking component defining the channel; and to thereby secure the stair liner to the pool stairs.

12. The pool stair assembly as defined in claim 11, wherein the locking component comprises:

a first wall having an outer surface, an inner surface, a first end, a second end, a top and a bottom;

a second wall having an outer surface, an inner surface, a first end, a second end, a top and a bottom, and wherein the second wall is disposed parallel to the first wall and spaced a distance therefrom; and a rib extending between the inner surface of the first wall and the inner surface of the second wall and spaced a distance downwardly away from the tops of the first and second walls; and wherein the channel is defined by a region of the inner surface of the first wall, a region of the inner surface of the second wall, and an upper surface of the rib.

13. The pool stair assembly as defined in claim 12, wherein the locking component further comprises:

a first lip extending inwardly into the channel from the inner surface of the first wall, wherein said first lip is disposed proximate the top of the first wall.

14. The pool stair assembly as defined in claim 13, wherein the locking rod is generally cylindrical and has an exterior surface, a first end and a second end; and a first groove is defined in the exterior surface of the locking rod, wherein the first groove is disposed substantially parallel to a longitudinal axis of the locking rod and extends from the first end of the locking rod to the second end thereof.

15. A method of installing a vinyl pool stair liner on a pool stair assembly which includes a first step having a first tread and a first riser, and a second step having a second step and a second riser; wherein the method includes the steps of:

securing a first locking component between the second tread and the first riser;

positioning a second riser portion of the stair liner adjacent the second riser;

positioning a second tread portion of the stair liner adjacent the second tread;

positioning a region of a vinyl flap which extends away from the exterior surface of the second tread portion across an opening to a first channel in the first locking component;

placing a first locking rod on the region of the vinyl flap that extends across the opening to the first channel;

engaging a bottom end of an installation tool in abutting contact with an interior surface of the first locking rod;

striking a top end of the installation tool with a hammer; and driving the first locking rod and the region of the vinyl flap into the channel with the installation tool until substantially the entire first locking rod is received within the first channel and the region of the vinyl flap is clamped between the first locking rod and an inner surface of the first locking component defining the first channel.

16. The method as defined in claim 15, further comprising the step of:

pulling a free end of the vinyl flap upwardly to tighten the stair liner to the second tread.

17. The method as defined in claim 16, further comprising the steps of:

removing the installation tool from its engagement with the locking rod;

positioning the second tread portion over the secured flap;

positioning a first riser portion of the stair liner over a free end of the secured flap and along the first riser;

positioning a first tread portion of the stair liner over the first tread on the stairs;

securing a second locking component between the first tread and a pool wall;

positioning a region of a second flap of the stair liner which is secured to an exterior surface of the first tread portion thereof across an opening to a channel in the second locking component;

placing a second locking rod on the region of the second flap that extends across the opening to the channel in the second locking component;

engaging the bottom end of the installation tool in abutting contact with an interior surface of the second locking rod;

striking the top end of the installation tool with the hammer;

driving the second locking rod and the region of the second flap into the channel of the second locking component with the tool until substantially the entire second locking rod is received within the second channel and the region of second flap is clamped between the second locking rod and an inner surface of the second locking component defining the second channel; and pulling a free end of the second vinyl flap upwardly to tighten the stair liner to the first tread.

18. The method as defined in claim 17, further comprising the step of: securing the vinyl stair liner to a surrounding region of a vinyl pool liner.

19. In combination, a vinyl pool stair liner having an interior surface and an exterior surface; and a locking system for securing the vinyl pool stair liner to a set of pool stairs, wherein said system comprises:

a locking component adapted to be secured to the pool stairs; and a locking rod selectively engageable with the locking component; wherein the locking rod secures a flap of vinyl extending away from the exterior surface of the stair liner into the locking component such that a portion of the flap is captured between the locking component and the locking rod; and wherein the locking component comprises: a first wall having an outer surface, an inner surface, a first end, a second end, a top and a bottom;

a second wail having an outer surface, an inner surface, a first end, a second end, a top and a bottom, and wherein the second wall is disposed parallel to the first wall and spaced a distance therefrom; and a rib extending between the inner surface of the first wall and the inner surface of the second wall and spaced a distance downwardly away from the tops of the first and second walls; and wherein the channel is defined by a region of the inner surface of the first wall, a region of the inner surface of the second wall, and an upper surface of the rib.

20. The combination as defined in claim 19, wherein the locking component defines a channel and the entire locking rod is received in the channel; and the portion of the flap of vinyl that is captured between the locking component and locking rod is disposed within the channel.

* * * * *

UNITED STATES PATENT AND TRADEMARK OFFICE

CERTIFICATE OF CORRECTION

PATENT NO. : 8,661,749 B2
APPLICATION NO. : 13/339816
DATED : March 4, 2014
INVENTOR(S) : Michael Gibson It is certified that error appears in the above-identified patent and that said Letters Patent is hereby corrected as shown below:

On the Title Page, right hand column item (74) Attorney, Agent, or Firm section "Sand & Seboly" should be corrected to "Sand & Sebolt"

In the Claims:

Column 8, line 25 (Claim 1) "a second wail" should be changed to --a second wall--

Column 12, line 4 (Claim 19) "a second wail" should be changed to --a second wall--

Signed and Sealed this
Twentieth Day of May, 2014

Michelle K. Lee

Michelle K. Lee
*Deputy Director of the United States Patent and Trademark Office*